US007901278B2

(12) United States Patent
O'Hagin

(10) Patent No.: US 7,901,278 B2
(45) Date of Patent: Mar. 8, 2011

(54) HYBRID METAL-PLASTIC ROOF VENT

(76) Inventor: Harry T. O'Hagin, Pranakorn Sri Ayutthaya (TH)

( * ) Notice: Subject to any disclaimer, the term of this patent is extended or adjusted under 35 U.S.C. 154(b) by 1175 days.

(21) Appl. No.: 11/506,402

(22) Filed: Aug. 18, 2006

(65) Prior Publication Data

US 2007/0060041 A1 Mar. 15, 2007

Related U.S. Application Data

(60) Provisional application No. 60/709,856, filed on Aug. 20, 2005.

(51) Int. Cl.
*F24F 7/02* (2006.01)

(52) U.S. Cl. ..... 454/365; 454/366; 454/367; 454/368; 52/198; 52/199

(58) Field of Classification Search ..... 454/365, 454/366, 367, 368, 343, 900; 52/198, 199
See application file for complete search history.

(56) References Cited

U.S. PATENT DOCUMENTS

| | | | | |
|---|---|---|---|---|
| 4,399,743 | A | 8/1983 | Izzi, Sr. | |
| 5,081,914 | A | 1/1992 | Mejia | |
| 5,394,663 | A * | 3/1995 | Jackson | 52/199 |
| 6,050,039 | A | 4/2000 | O'Hagin | |
| 6,244,006 | B1 | 6/2001 | Shue et al. | |
| 6,354,051 | B1 | 3/2002 | O'Hagin | |
| 6,447,390 | B1 | 9/2002 | O'Hagin | |
| 6,491,579 | B1 | 12/2002 | O'Hagin | |
| 6,520,852 | B2 | 2/2003 | McKee et al. | |
| 6,733,381 | B1 | 5/2004 | Ploeger | |
| 6,805,627 | B2 | 10/2004 | Marts et al. | |

FOREIGN PATENT DOCUMENTS

| | | | |
|---|---|---|---|
| DE | 20 2001 009 235 | U1 | 12/2004 |
| EP | 0 663 487 | A1 | 7/1995 |
| EP | 0953089 | B1 * | 8/2003 |
| FR | 2 863 636 | | 6/2005 |
| GB | 2 157 738 | A | 10/1985 |
| GB | 2 183 819 | A | 6/1987 |
| GB | 2 262 949 | A | 7/1993 |
| GB | 2 317 947 | A | 4/1998 |
| GB | 2 345 536 | A | 7/2000 |

OTHER PUBLICATIONS

"Transitions & Duct Ends." DuctMonkey.net. N. p., Feb. 2005. Web. Apr. 9, 2010. <http://web.archive.org/web/20050405163101/www.ductmonkey.net/>.*

* cited by examiner

*Primary Examiner* — Steven B McAllister
*Assistant Examiner* — Seth Greenia
(74) *Attorney, Agent, or Firm* — Knobbe, Martens, Olson & Bear LLP

(57) ABSTRACT

A vent for a tile roof is disclosed. The vent includes a first member preferably substantially formed of a metal, a second member preferably substantially formed of a plastic material, and a connector attached to the underside of the second member. The second member is positioned below and spaced apart from the first member. The first and second members together define a ventilation gap therebetween. The first member and second member are preferably releasably connected to each other. The connector is configured to connect with an air conduit. The connector is further configured to be compatible with a plurality of sizes and types of air conduits. The ventilating access and the connector are together configured to permit airflow between above the roof and the air conduit.

43 Claims, 9 Drawing Sheets

HYBRID METAL-PLASTIC ROOF VENT

CLAIM FOR PRIORITY

This application claims the priority benefit under 35 U.S.C. §119(e) of Provisional Application Ser. No. 60/709,856, filed Aug. 20, 2005. The full disclosure of this priority application is incorporated herein by reference.

BACKGROUND OF THE INVENTION

1. Field of the Invention

This invention relates to roof vents, and more particularly for vents adapted for use on a tile roof.

2. Description of the Related Art

Known systems for venting roofs employ vents that are substantially formed of a single material. Some roof-vents are formed substantially of plastic, which is inexpensive and highly impact resistant, but degrades relatively easily when exposed to rain, snow, and the sun. In particular, the cover of a roof-vent is continually exposed to the elements and may degrade more rapidly than the rest of the vent. Other roof-vents are formed substantially of metal, which is more resistant to the elements but is expensive and susceptible to rust, denting, and other damage during transport and installation.

Some buildings include "stack vents" (i.e., pipes or ducts) with lower ends terminating in rooms likely to have higher pollutant levels, such as kitchens, bathrooms, and laundry rooms, and upper ends extending vertically through the roof. These stack vents are also sometimes referred to as "soil vents." The stack vent typically extends upward through the ceiling of the room and eventually through the roof of the building, terminating at an upper open end. The stack vent typically also extends upward through other rooms and/or an attic of the building.

The prior art teaches roof-vents that can connect with various sizes of stack vents. Examples of such vents include U.S. Pat. No. 4,399,743 to Izzi, Sr. and U.S. Pat No. 5,081,914 to Mejia. Izzi and Mejia teach structures that are integral with a vent cap and which have fittings of a few discrete sizes for receiving a few different sizes of stack vents. These arrangements preclude connection of the vent to stack vents having sizes other than those conceived in the original design. The prior art also discloses roof vents that reside and blend in with a roof, while connecting directly to the upper end of a stack vent. For example, U.K. Patent Application Publication No. 2 317 947 A to Hensey et al. discloses a covert roof ventilator manufactured by rotation molding from plastics material and provided with an upper wall of shape complementary to roof tiles and an apertured lower wall.

SUMMARY OF THE INVENTION

In accordance with one aspect, a vent for a roof is provided comprising: a first member substantially formed of a metal or alloy; a second member substantially formed of a plastic material and having at least one opening; and an air-conveying connector configured to attach to an underside of the second member and in fluid communication with the opening. The first member is adapted to be positioned within and exposed at an upper surface of a roof. The second member is configured to attach to and be positioned below and spaced apart from the first member to define a ventilation gap therebetween. The at least one opening is covered by the first member when the first and second members are attached to substantially prevent rain from entering the opening. The ventilation gap is in fluid communication with an area above the first member when the first and second members are installed within a roof. A lower air-conveying portion of the connector is configured to connect with an air conduit to allow airflow from the air conduit upward through the connector, the opening, and the ventilation gap.

In accordance with another aspect, a vent for a tile roof is provided comprising a body formed substantially of a plastic material and a cover formed substantially of a metal or alloy. The body has an opening. The cover substantially covers the body. The cover and the body have a gap therebetween. The gap is in fluid communication with a region above the cover. The gap and the opening are together configured to permit airflow between the region above the cover and a region below the opening. The body and cover are adapted to be positioned in a roof such that the cover is exposed at an upper surface of the roof.

In accordance with another aspect, a method of ventilating a building is provided. The method comprises providing an air conduit having a lower end terminating within a building and an upper end terminating below and proximate to a roof having a layer of tiles. A first vent member is provided within the tile layer. The first member is substantially formed of a metal or an alloy. A second vent member substantially formed of a plastic material is provided. The second member is positioned below and spaced apart from the first member to define a ventilation gap therebetween. The second member has at least one opening that is covered by the first member to substantially prevent rain from entering the opening. The ventilation gap is in fluid communication with an area above the first member. An air-conveying connector is attached to an underside of the second member and in fluid communication with the opening. A lower air-conveying portion of the connector is connected with the upper end of the air conduit to allow airflow from the air conduit upward through the connector, the opening, and the ventilation gap.

In accordance with another aspect, a vent for a roof is provided comprising a first member adapted to be positioned within and exposed at an upper surface of a roof; a second member configured to attach to and be positioned below and spaced apart from the first member to define a ventilation gap therebetween and having at least one opening; and an air-conveying connector configured to attach to an underside of the second member and in fluid communication with the opening. The at least one opening is covered by the first member when the first and second members are attached to substantially prevent rain from entering the opening. The ventilation gap is in fluid communication with an area above the first member when the first and second members are installed within a roof. A lower air-conveying portion of the connector is configured to connect with an air conduit to allow airflow from the air conduit upward through the connector, the opening, and the ventilation gap. The first member and second member are releasably connected to each other to facilitate selective attachment and detachment of the first and second members while the second member remains installed on a roof.

In accordance with another aspect, a method of ventilating a building is provided. The method comprises providing an air conduit having a lower end terminating within a building and an upper end terminating below and proximate to a roof having a tile layer. A first vent member is then provided within the tile layer. A second vent member is positioned below and spaced apart from the first member to define a ventilation gap therebetween. The second member has at least one opening that is covered by the first member to substantially prevent rain from entering the opening. The ventilation gap is in fluid communication with an area above the first member. An air-conveying connector is attached to an underside of the second member and in fluid communication with the opening. A lower air-conveying portion of the connector is connected with the upper end of the air conduit to allow airflow from the air conduit upward through the connector, the opening, and the ventilation gap. The first and second members are releasably connected together to facilitate selective attachment and detachment of the first and second members while the second member remains installed on the roof.

In accordance with another aspect, a vent for a roof is provided comprising: a first member adapted to be positioned within and exposed at an upper surface of a roof; a second member configured to attach to and be positioned below and spaced apart from the first member to define a ventilation gap therebetween and having at least one opening; and a plurality of air-conveying connectors each configured to attach to a lower fitting of the second member and be in fluid communication with the opening. The at least one opening is covered by the first member when the first and second members are attached to substantially prevent rain from entering the opening. The ventilation gap is in fluid communication with an area above the first member when the first and second members are installed within a roof. Only one of the connectors is able to attach to the lower fitting at a time. A lower air-conveying portion of each connector is configured to connect with an air conduit to allow airflow from the air conduit upward through the connector, the opening, and the ventilation gap. The lower portions of the connectors have different sizes and/or shapes to be compatible with a plurality of different sizes and/or shapes of air conduits.

In accordance with another aspect, a method of ventilating a building is provided. The method comprises providing a stack vent having a lower end terminating within the building and an upper end terminating below and proximate to a roof having a layer of tiles. Then, a first vent member is provided within the tile layer. A second vent member is positioned below and spaced apart from the first member to define a ventilation gap therebetween. The second member has at least one opening that is covered by the first member to substantially prevent rain from entering the opening. The ventilation gap is in fluid communication with an area above the first member. A plurality of air-conveying connectors is provided. Each of the air-conveying connectors is configured to attach to a lower fitting of the second member and be in fluid communication with the opening. Only one of the connectors is able to attach to the lower fitting at a time. A lower air-conveying portion of each connector is configured to connect with an air conduit to allow airflow from the air conduit upward through the connector, the opening, and the ventilation gap. The lower portions of the connectors have different sizes and/or shapes to be compatible with a plurality of sizes and/or shapes of air conduits. One of the connectors is selected. The selected connector has a lower air-conveying portion configured to connect with and fluidly communicate with the upper end of the stack vent. The selected connector is attached to the lower fitting of the second member in fluid communication with the opening. The lower portion of the selected connector is connected to the upper end of the stack vent.

In accordance with another aspect, a vent for a roof is provided comprising: a first member adapted to be positioned within and exposed at an upper surface of a roof; a second member configured to attach to and be positioned below and spaced apart from the first member to define a ventilation gap therebetween, and having at least one opening; an air-conveying connector configured to attach to an underside of the second member and in fluid communication with the opening and having a lower fitting; and a plurality of air-conveying adapters each having an upper end configured to connect with and convey air into the lower fitting of the connector. The opening is covered by the first member when the first and second members are attached to substantially prevent rain from entering the opening. The ventilation gap is in fluid communication with an area above the first member when the first and second members are installed within a roof. Each adapter has a lower end configured to connect with and receive air from an upper end of an air conduit to allow airflow from the air conduit upward through the adapter, the connector, the opening, and the ventilation gap. Only one of the adapters is able to connect with the lower fitting at a time. The lower ends of the adapters having different sizes and/or shapes to be compatible with a plurality of different sizes and/or shapes of air conduits.

In accordance with yet another aspect, a method of ventilating a building is provided. The method comprises providing a stack vent having a lower end terminating within the building and an upper end terminating below and proximate to a roof having a layer of tiles. A first vent member is provided within the tile layer. A second vent member is provided below and spaced apart from the first member to define a ventilation gap therebetween. The second member has at least one opening that is covered by the first member to substantially prevent rain from entering the opening. The ventilation gap is in fluid communication with an area above the first member. An air-conveying connector is attached to an underside of the second member and in fluid communication with the opening. The connector has a lower fitting. A plurality of air-conveying adapters are provided, each having an upper end configured to connect with and convey air into the lower fitting of the connector. Each adapter has a lower end configured to connect with and receive air from an upper end of an air conduit to allow airflow from the air conduit upward through the adapter, the connector, the opening, and the ventilation gap. Only one of the adapters is able to connect with the lower fitting at a time. The lower ends of the adapters have different sizes and/or shapes to be compatible with a plurality of different sizes and/or shapes of air conduits. One of the adapters is selected such that the selected adapter has a lower end configured to connect with and fluidly communicate with the upper end of the stack vent. The selected adapter is attached to the lower fitting of the connector in fluid communication with the opening. The lower end of the selected adapter is connected to the upper end of the stack vent.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

One aspect of the invention provides a roof vent including a metallic cover and a plastic body. A metal is typically more resistant to the elements than a plastic material. On the other hand, the latter is less expensive than the former and does not rust. Since the cover is more exposed to the elements than the intermediate member, the combination of a metallic cover and a plastic body enhances the lifetime of the roof vent while reducing the overall manufacturing cost. Another aspect of the invention provides a cover releasably connected to the remainder of the vent body, which allows replacing a damaged cover while re-using an undamaged vent body. Yet another aspect of the invention provides modularity of connectors and adapters, which allows a standardized roof vent to fit various sizes and configurations of stack vents.

Figure 1:
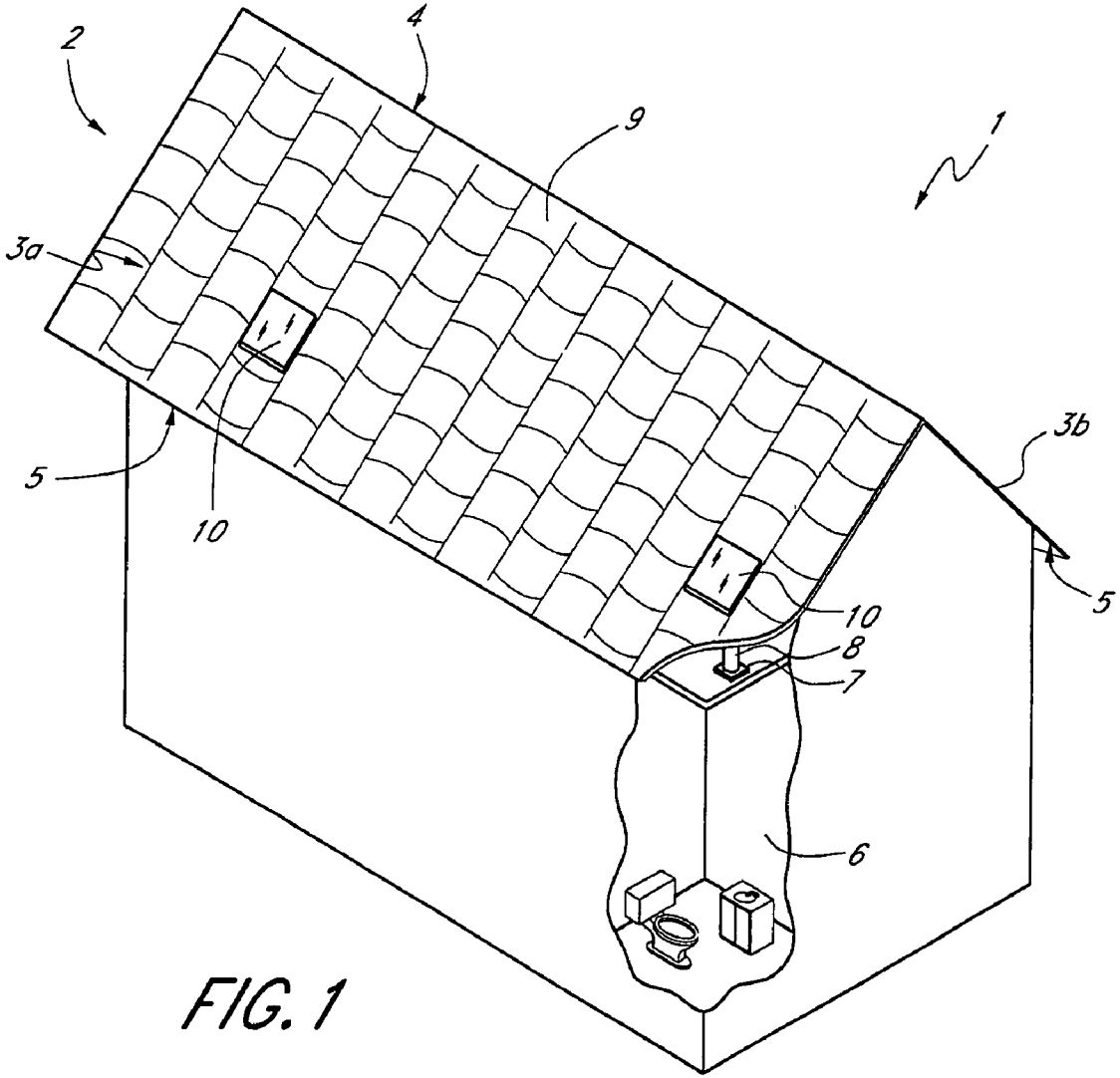
FIG. 1 is a perspective view of a building with a tile roof having roof vents according to one embodiment of the invention.

FIG. 1 shows a building 1 with a roof 2 according to one embodiment. The roof 2 comprises two fields 3*a* and 3*b* that are joined at their upper ends to define a ridge 4. Lower edges 5 of the fields are referred to as "eaves." The fields 3*a* and 3*b* that comprise a roof supporting structure (not shown) covered with tiles 9 (e.g., clay or concrete). The roof typically comprises rafters, a deck on top of the rafters, battens, and the tiles 9.

The building 1 also includes a living space 6 which typically requires ventilation. Examples of such living space include, but are not limited to, a restroom, a kitchen, a bedroom, a dining room, a living room, and a basement. In certain embodiments, drains or soil pipes of the building 1 may also require ventilation.

Such a living space 6 or drains may be provided with an active or passive ventilation system. The illustrated ventilation system is of an active type. The ventilation system includes a fan 7, a stack vent 8, and a roof vent 10. It will be understood that a passive ventilation system would not employ any fans 7. The fan 7 generates airflow from the living space 6 through the stack vent 8 to the roof vent 10. The stack vent 8 provides an air conduit between the living space 6 and the roof vent 8. The stack vent 8 may comprise a pipe, a flexible tube, hose, or a combination of two or more of the foregoing. In another embodiment, the fan 7 may be omitted and the stack vent 8 may terminate below the ceiling of the living space 6. Skilled artisans will appreciate that the configuration of the ventilation system may vary depending on ventilation needs and building designs. Also, skilled artisans will appreciate that the roof vent 10 may be provided in a wide variety of different types of roofs, including those not having ridges or sloped fields. Additional vents may be provided on different parts of the field 3*a* and, 3*b* that, depending on the ventilation needs of the building 1.

Figure 2:
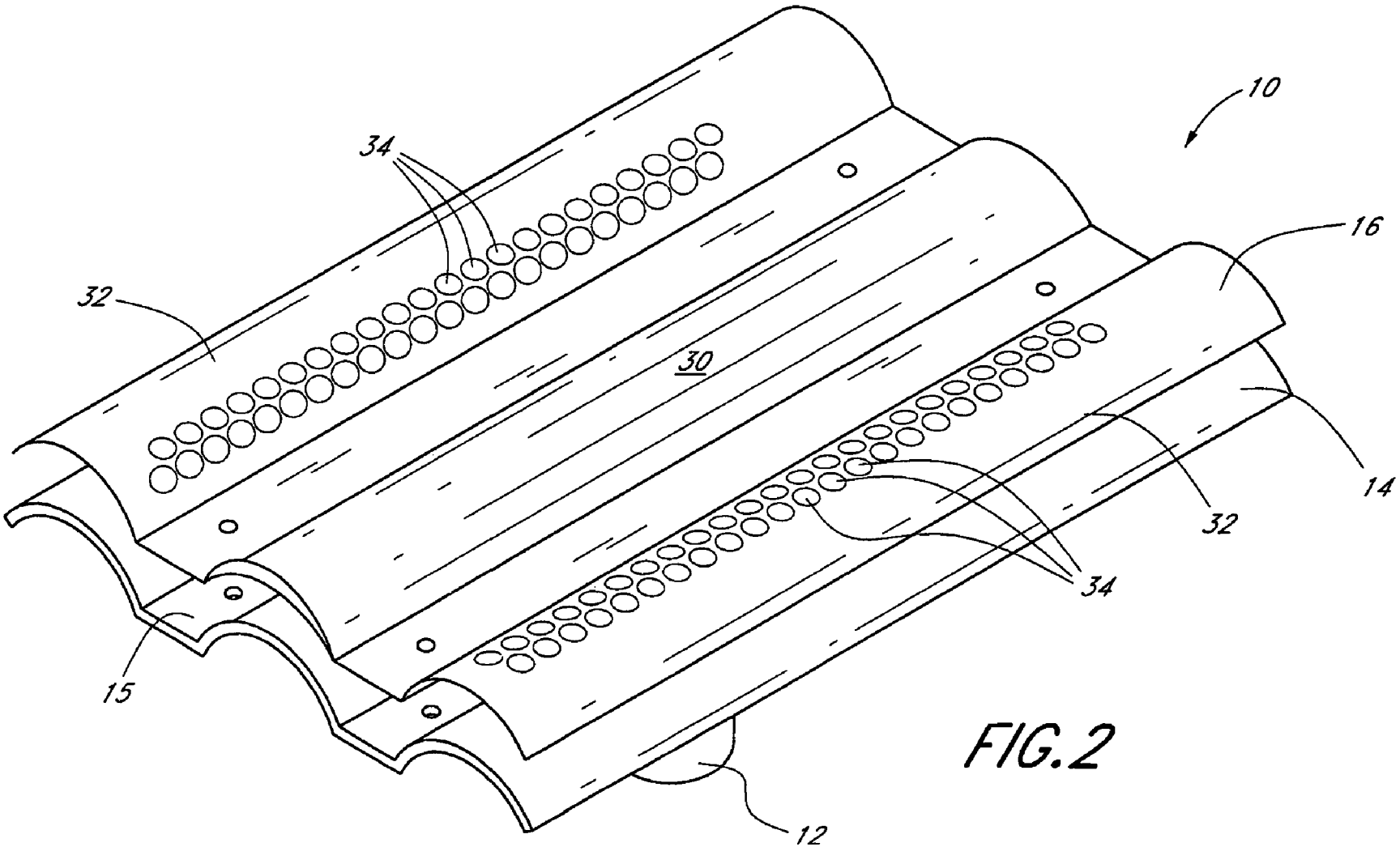
FIG. 2 is a top perspective view of a vent according to one embodiment of the invention.
Figure 3:
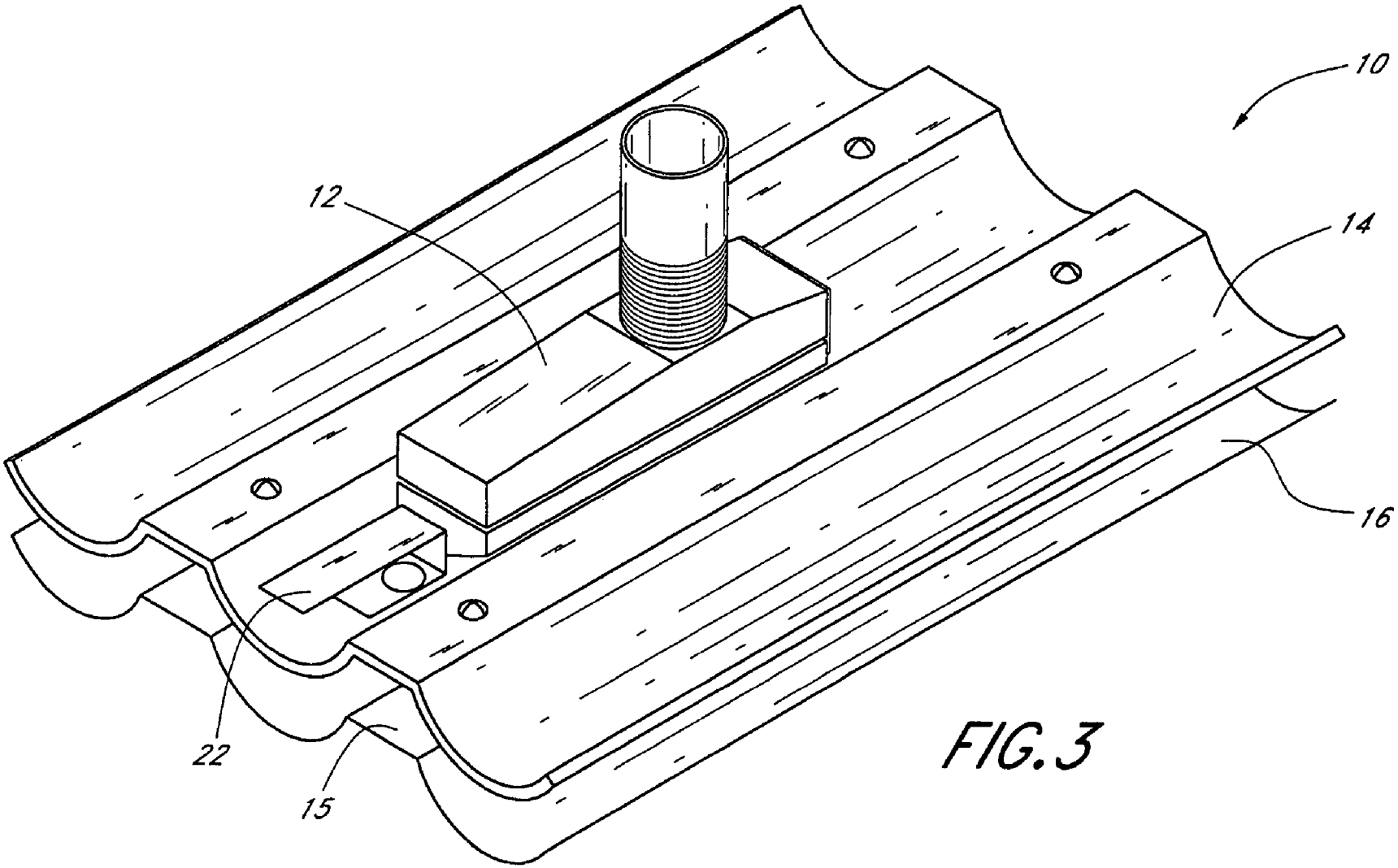
FIG. 3 is a bottom perspective view of the vent of FIG. 2 viewed from below.
Figure 4:
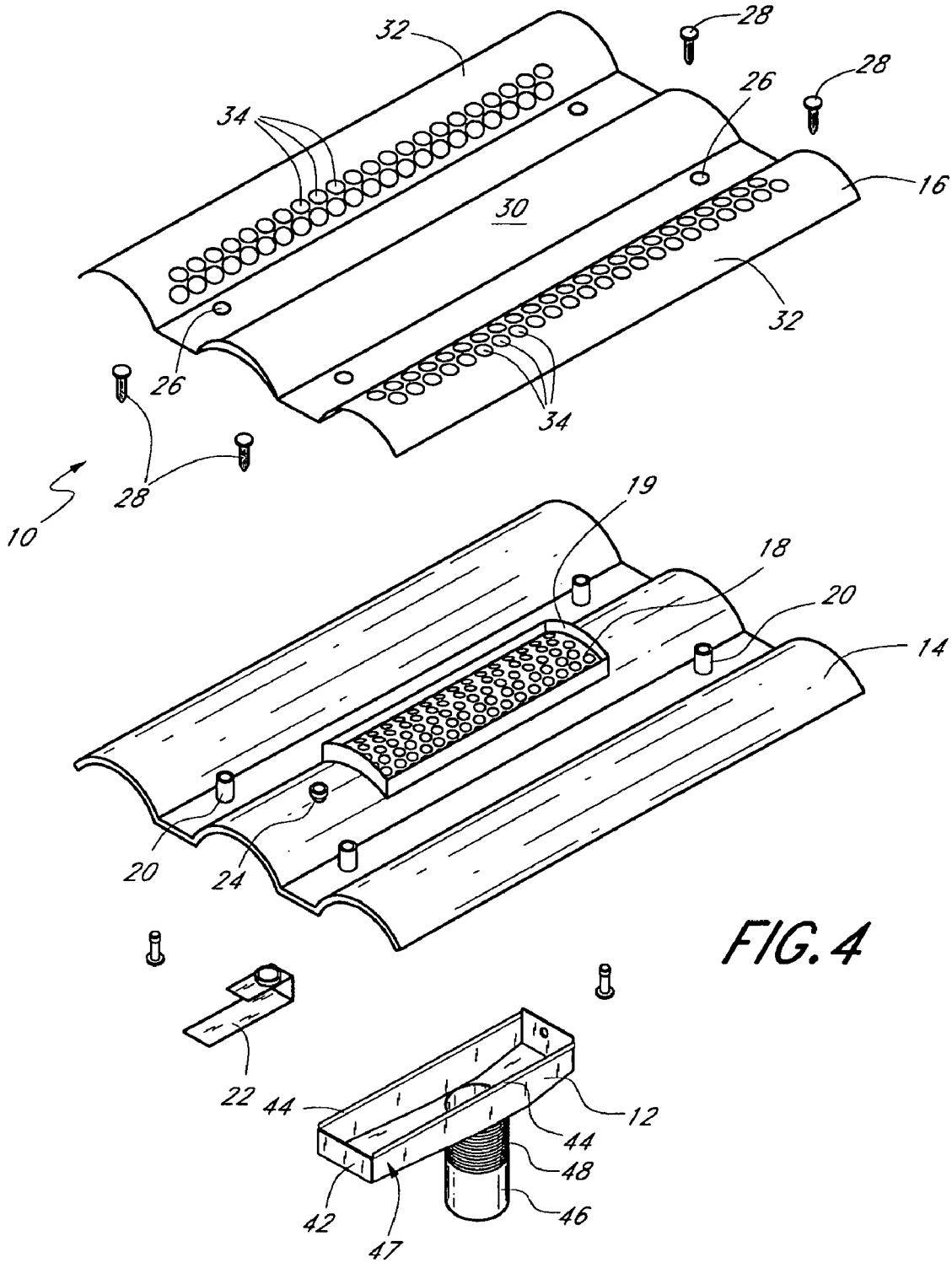
FIG. 4 is an exploded top perspective view of the vent of FIG. 2.

FIGS. 2-4 show a vent 10 comprising a stack vent connector 12, an intermediate member 14, and a cover 16. The vent 10 is preferably designed to conform to the profile of a tile roof. Accordingly, the intermediate member 14 and the cover 16 are preferably shaped like the tiles of a tile roof. A wide variety of shapes and sizes of the intermediate member 14 and the cover 16 are possible, depending upon the type of tiles employed in the tile roof.

Referring to FIG. 4, the intermediate member 14 is substantially formed of a plastic material. Examples of the plastic material include, but are not limited to, polyvinyl chloride (PVC), polyethylene, polypropylene, and polyurethane. The intermediate member 14 includes a central section 18 that permits airflow through the intermediate member 14. The central section 18 can be a single large opening. The opening may be covered by a screen to prevent entry of insects, vermin, and debris larger than the screen openings. Alternatively, the central section 18 may comprise a plurality of small openings in the body of the intermediate member 14 or in a separate piece assembled with the body of the intermediate member 14. The intermediate member 14 may also include one or more baffles configured to prevent water from entering the central section 18, such as an upstanding baffle wall 19 surrounding the central section 18. The baffle wall 19 is configured to prevent ingress of water into the opening(s) of the central section 18. The intermediate member 14 also includes four spacer tubes 20, described in detail below. A storm clip 22 is secured to the underside of the intermediate member 14 at an opening 24. The storm clip 22 is configured to receive the upper end of an immediately lower tile for the purpose of restraining the tiles against winds.

The cover 16 is substantially formed of a metallic material. Examples of the metallic material include, but are not limited to, steel, galvanized steel, aluminum, and copper. Other metallic materials suitable to withstand various weather conditions may also be used. The cover 16 preferably has substantially the same profile as the intermediate member 14. The cover 16 includes openings 26 configured to align with the spacer tubes 20. The cover 16 also includes snap-lock members 28 configured to extend through the openings 26 into the spacer tubes 20, to thereby engage the intermediate member 14 and the cover 16 in a spaced relationship. The number and size of the spacer tubes 20, openings 26, and snap-lock members 28 can vary. Additionally, other fastening means can be used within the scope of the invention. In a preferred embodiment, the snap-lock members 28 are configured to detach from the spacer tubes 20, so that the cover 16 can be selectively attached and detached from the intermediate member 14.

In certain embodiments, the spacer tubes 20 may be replaced by spacer elements configured to serve as baffles to further prevent ingress of water into the opening(s) of the central section 18. Such spacer elements may be of various shapes depending on the configurations of the cover 16 and the intermediate member 14. The spacer elements may also be shaped to direct airflow between the cover 16 and the intermediate member 14. For example, the spacer elements may be horizontally elongated such that winds blowing into the ventilation gap 15 of the vent 10 do not directly reach the central section 18. This configuration further deflects rain from entering the opening(s) of the central section 18. It will be appreciated that in any of the embodiments described above, each of the spacer tubes 20 or other spacer elements may be attached to either the cover 16 or the intermediate member 14. It will be also appreciated that the shapes of the spacer tubes 20 or other spacer elements can vary widely depending on the baffling needs and/or configurations of the cover 16 and the intermediate member 14.

The cover 16 includes a central portion 30 positioned over the central section 18 of the intermediate member 14. The central portion 30 does not include any openings, thereby covering the central section 18 and limiting the ingress of rain and other debris down through the central section 18. The cover 16 includes wing portions 32 having openings 34.

Figure 5:
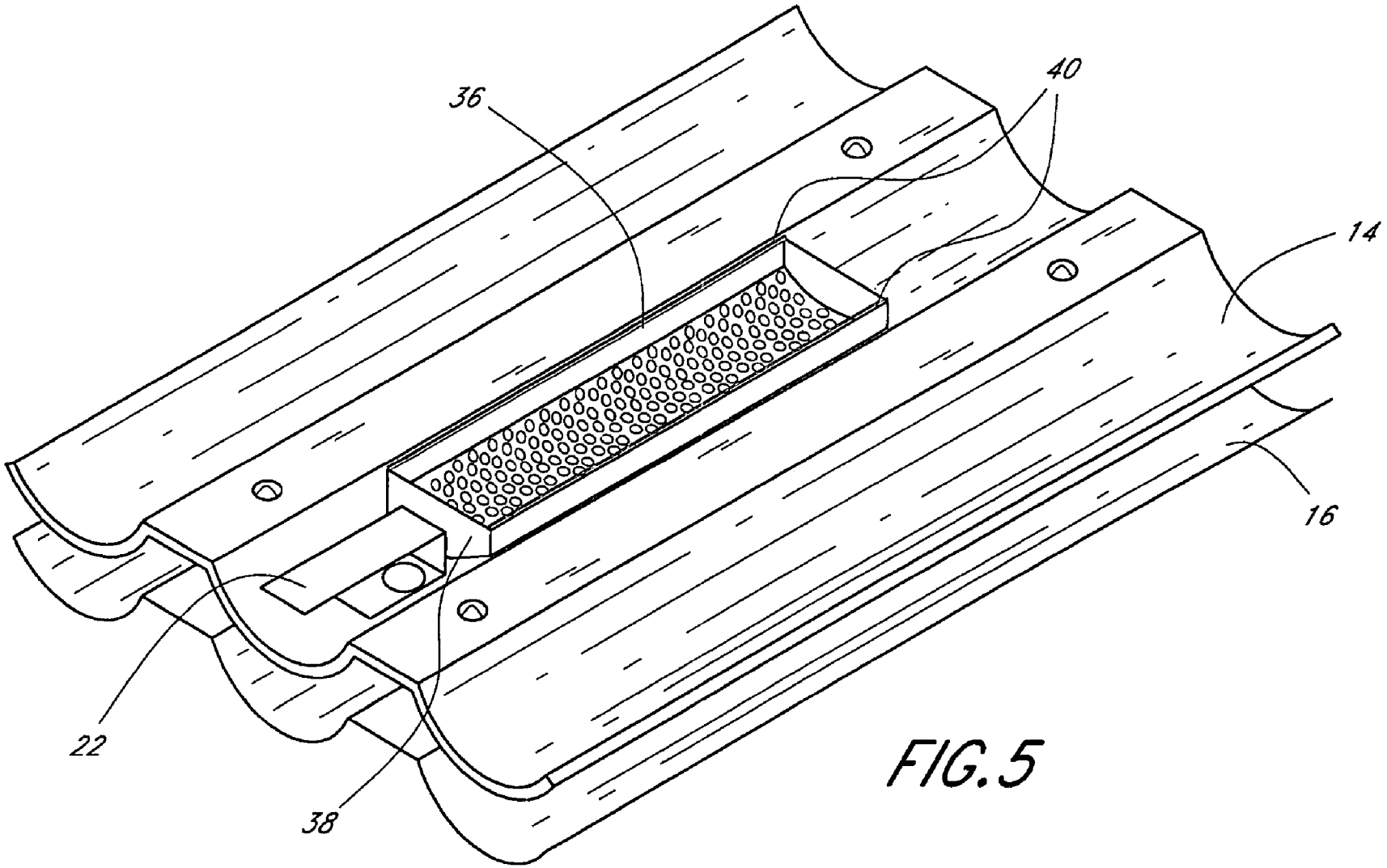
FIG. 5 is a bottom perspective view of the vent of FIG. 2 with the stack vent connector removed.
Figure 6B:
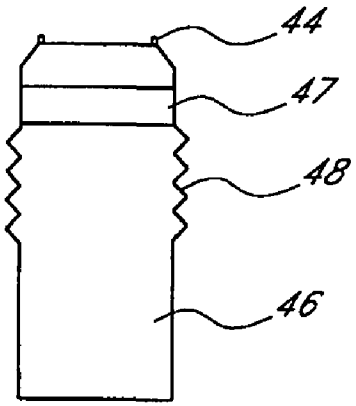
FIG. 6B is a front view of the stack vent connector of the vent of FIG. 2.
Figure 6A:
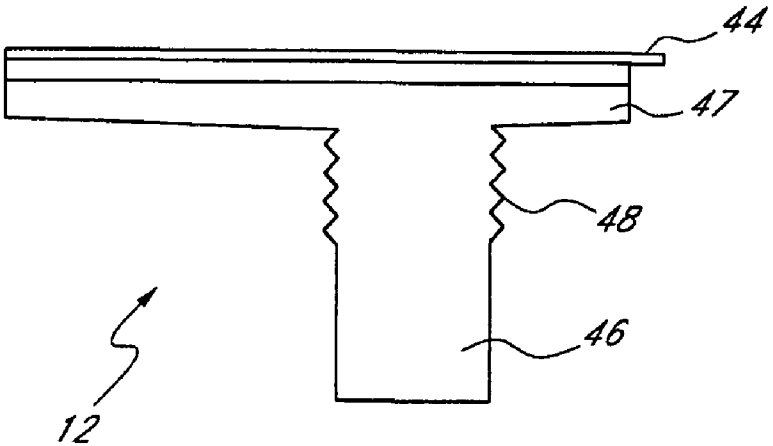
FIG. 6A is a side view of the stack vent connector of the vent of FIG. 2.
Figure 6C:
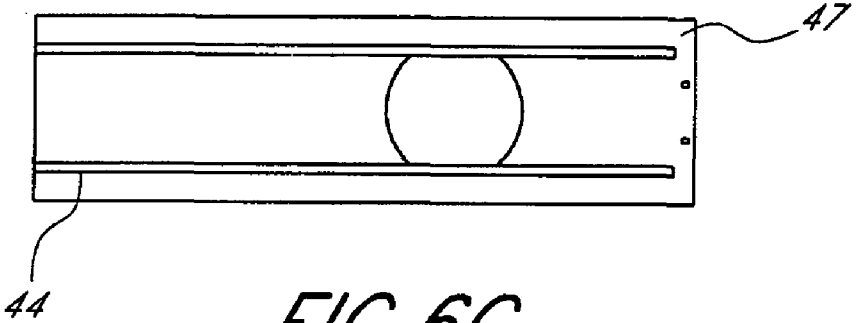
FIG. 6C is a top view of the stack vent connector of the vent of FIG. 2.
Figure 7C:
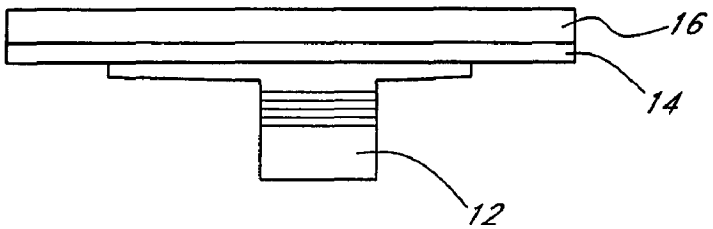
FIG. 7C is a side view of the vent of FIG. 2.
Figure 7A:
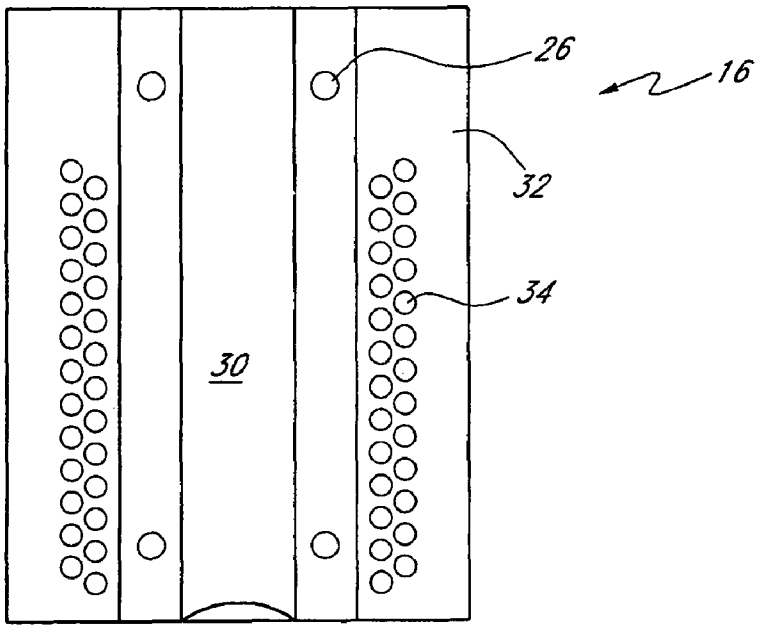
FIG. 7A is a top view of the vent of FIG. 2.
Figure 7B:
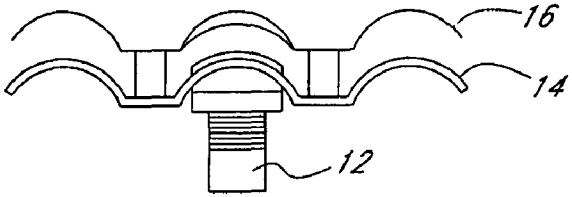
FIG. 7B is a front view of the vent of FIG. 2.

The stack vent connector 12 is formed of a plastic material. Preferably, the stack vent connector 12 is formed of the same material as that of the intermediate member 14. It comprises a lower (e.g., tubular) portion 46 and an upper fitting 47 configured to connect to the underside of the intermediate member 14. As shown in FIG. 5, the underside of the central section 18 of the intermediate member 14 includes a lower fitting 36 for connection to the upper fitting 47 of the stack vent connector 12. This connection can optionally be substantially air-tight and preferably allows selective attachment and detachment of the stack vent connector 12 and intermediate member 14.

In the illustrated embodiment, the lower fitting 36 comprises a rectangular flange 38 having two elongated tracks or grooves 40. As shown in FIG. 4, the upper fitting 47 comprises a rectangular flange 42 having two elongated tongues 44 configured to slide into the tracks 40. The lower portion 46 is configured to connect with, receive, or be received within the upper end of a stack vent. The lower portion 46 can have surface grooves 48 for more securely receiving a flexible tube-type stack vent. The illustrated lower portion 46 is tubular, but other shapes are possible within the scope of the invention.

Stack vent connectors 12 can be provided in different sizes and types to facilitate the connection of the vent 10 to stack vents of different sizes and types. Each connector 12 can have a standard fitting (e.g., upper fitting 47) for connection to the fitting (e.g., lower fitting 36) on the underside of the central section 18 of the intermediate member 14. Skilled artisans will recognize that a wide variety of different types of fittings are possible for connecting the stack vent connector 12 to the intermediate member 14.

Figure 8:
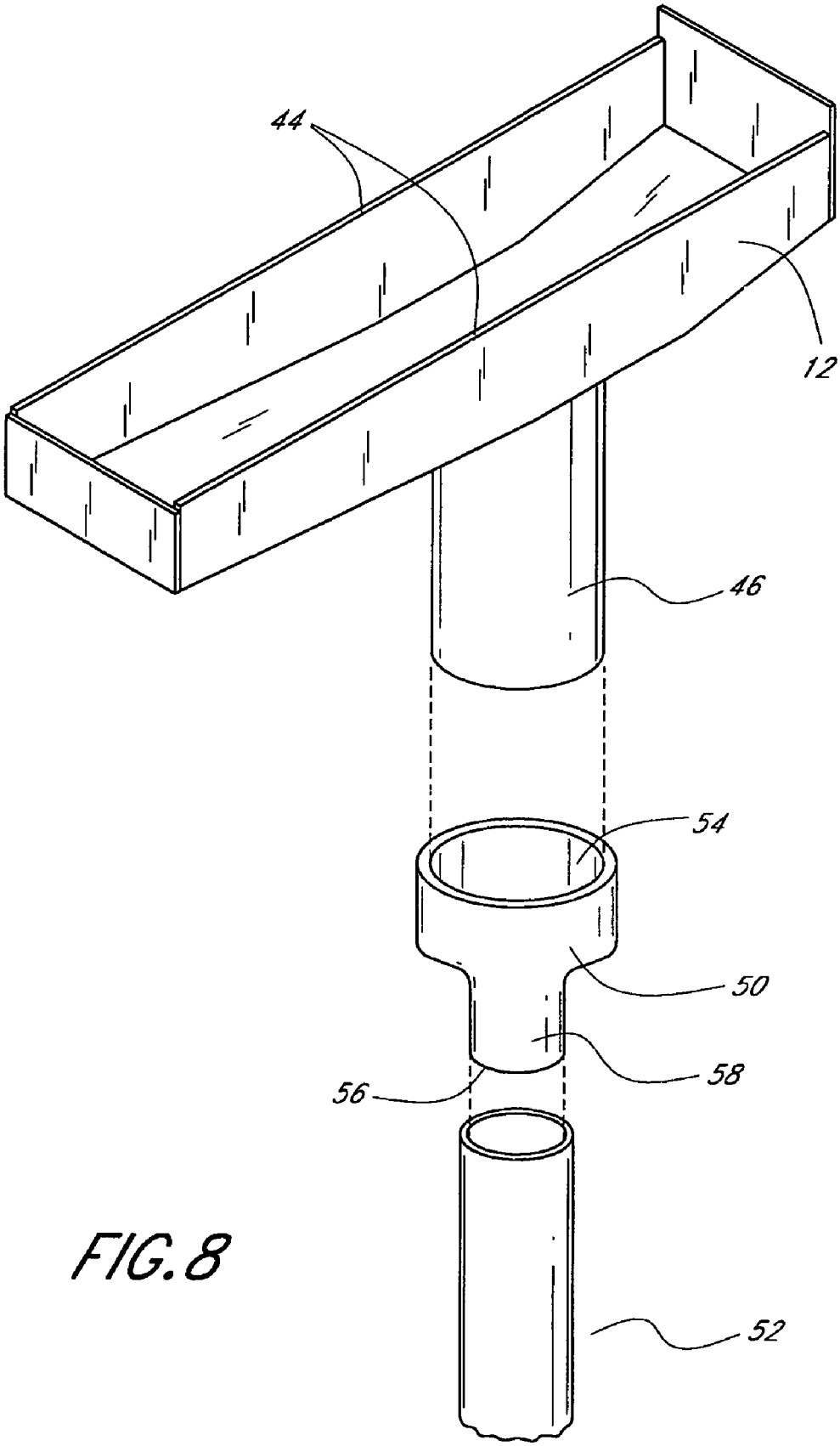
FIG. 8 is an exploded top perspective view of a connection of a stack vent connector to a stack vent through an adapter according to one embodiment of the invention.

The lower portions 46 of the different connectors 12 can connect to interchangeable adapters. In some embodiments, the adapters may be integral with the lower portion 46 so that different connectors 12 can integrally include adapters of varying sizes to facilitate connection to a variety of different stack vents. Alternatively, the lower portion 46 can have a standard size, with an additional adapter being provided between the stack vent and the connector 12. Such adapters may be provided in a variety of sizes to facilitate connection with a variety of different sizes and types of stack vents. The adapters may be configured to provide a sealed connection between the stack vent and the connector 12. FIG. 8 shows one embodiment of an adapter 50. The adapter 50 includes an upper opening 54 that receives the lower portion 46 of the stack vent connector 12, and a lower opening 56 in a portion 58 received within a stack vent 52. Other types of adapters 50 are possible within the scope of the invention.

In use, air flows up through the stack vent, into the connector 12, through the central section 18 of the intermediate member 14, and then around the edges of the cover 16 and/or through the openings 34. In certain embodiments, a gap 15 between the cover 16 and the intermediate member 14 defines a ventilation gap to the outside. The ventilation gap is in ventilating communication with the stack vent through the connector 12, and thus permits airflow therebetween. In such embodiments, the cover 16 may have a downwardly depending baffle or flange at its lower edge. The flange may be configured to allow airflow underneath it to ventilation gap while preventing ingress of rain or snow. Note that the vent 10 can be used with a manifold so that multiple stack vents terminate at the single vent 10.

Figure 9:
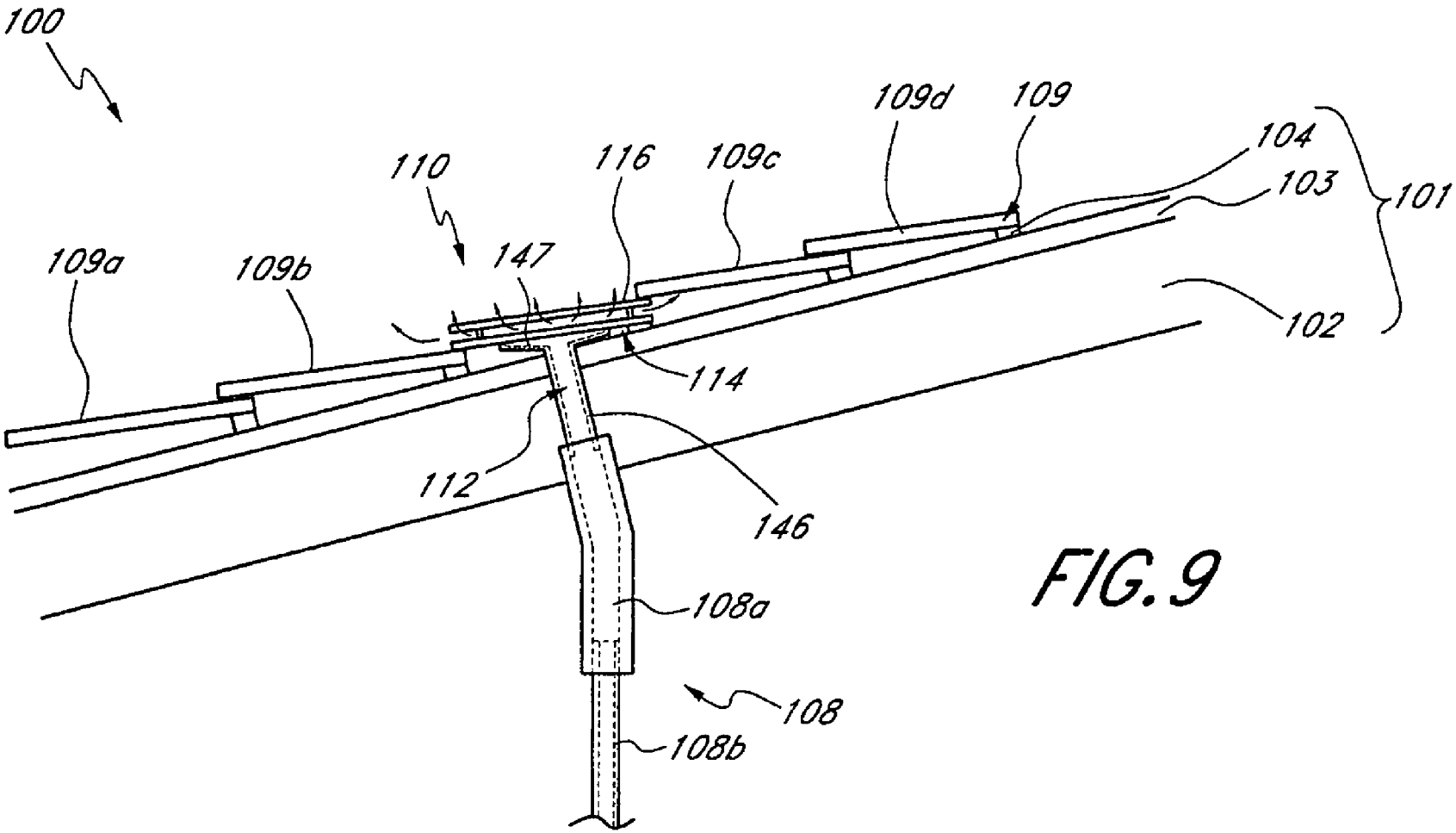
FIG. 9 is a cross-sectional view of a tile roof with a vent connected to a stack vent according to one embodiment of the invention.

FIG. 9 illustrates a cross-sectional view of a roof 100 having a roof vent according to one embodiment. The illustrated roof 100 includes a roof supporting structure 101, a layer of tiles 109, a roof vent 110, and a stack vent 108.

The illustrated roof supporting structure 101 comprises rafters 102, a roof deck 103 over the rafters 102, and optionally battens 104 over the roof deck 103. The rafters 102 extend substantially perpendicular to a ridge and an eave (not shown) of the roof 100. The rafters 102 run substantially parallel to one another. The rafters 102 may be formed of, without limitation, a metal or wood. The roof deck 103 is directly supported on the rafters 102. The roof deck 103 is typically formed of plywood or sheet metal. The battens 104 extend substantially perpendicular to the rafters 102, and run substantially parallel to one another. In other embodiments, at least one of the rafters 102, the roof deck 103, and the battens 104 may be omitted or replaced with a different roof supporting element. It will be appreciated that the roof supporting structure 101 can have various other configurations depending on the design of the roof.

The layer of tiles 109 is mounted over the roof supporting structure 101. The illustrated tile layer 109 resides directly on the battens 104. The tiles may be formed of, without limitation, clay, a metal, or a plastic material. In the illustrated embodiment, a lower end of a tile 109 lies on an upper end of an immediately lower tile. An upper end of the tile 109 directly resides on one of the battens 104 while supporting a lower end of an immediately upper tile directly thereon.

The roof vent 110 is positioned within the layer of tiles 109. The roof vent 110 comprises a cover 116, an intermediate member 114, and a stack vent connector 112. The configurations of the foregoing elements can be as described above with respect to the roof vent 10.

As shown in FIG. 9, the cover 116 and intermediate member 114 of the roof vent 110 are positioned between immediately lower and upper tiles 109*b*, 109*c*. In addition, the cover 116 and intermediate member 114 are interposed between two horizontally neighboring tiles (not shown). The roof vent 110 can advantageously be mounted on the roof supporting structure 101 in a manner substantially the same as that in which the tiles 109*a*-109*d* are mounted.

The stack vent connector 112 includes an upper fitting 147 and a lower tubular portion 146. The upper fitting 147 is positioned between the intermediate member 114 of the roof vent 110 and the roof deck 103. The lower portion 146 extends from the upper fitting 147 to below the roof deck 103.

The stack vent 108 extends from a living space or drain of the building to immediately below the roof deck 103. The illustrated stack vent 108 includes a flexible tube 108*a* and a pipe 108*b* connected to each other. The upper end of the flexible tube 108*a* is connected to the lower portion 146 of the connector 112. In certain embodiments, the stack vent 108 may extend through the roof deck 103. In such embodiments, the stack vent 108 may be connected to the connector 112 in or above the roof deck 103. A skilled artisan will appreciate that the configuration and position of the stack vent 108 and connector 112 can vary depending on the ventilation needs and the roof design.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A vent for a roof, comprising:

a first member substantially formed of a metal or alloy, the first member adapted to be positioned within and exposed at an upper surface of a roof;

a second member substantially formed of a plastic material, the second member configured to attach to and be positioned below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member when the first and second members are attached to substantially prevent rain from entering the opening, the ventilation gap being in fluid communication with an area above the first member when the first and second members are installed within a roof; and an air-conveying connector configured to attach to an underside of the second member and in fluid communication with the opening, a lower air-conveying portion of the connector being configured to connect with an air conduit to allow airflow from the air conduit upward through the connector, the opening, and the ventilation gap.

2. The vent of claim 1, wherein the first member mimics an appearance of one or more roof tiles.

3. The vent of claim 2, wherein a shape of the second member is substantially the same as a shape of the first member.

4. The vent of claim 1, further comprising the air conduit, wherein the air conduit is a stack vent.

5. The vent of claim 4, wherein the stack vent comprises a pipe.

6. The vent of claim 4, wherein the stack vent comprises a flexible tube.

7. The vent of claim 1, further comprising the air conduit, wherein the air conduit comprises a manifold adapted to communicate with a plurality of stack vents.

8. The vent of claim 1, wherein the underside of the second member includes a fitting to which the connector is configured to attach, the vent further comprising a plurality of air-conveying adapters each having an upper end configured to connect with and convey air into the lower portion of the connector and a lower end configured to connect with and receive air from an upper end of a stack vent, only one of the adapters being able to connect with the lower portion of the connector at a time, the lower ends of the adapters having different sizes and/or shapes to be compatible with a plurality of different sizes and/or shapes of stack vents.

9. The vent of claim 1, wherein the underside of the second member includes a fitting to which the connector is configured to attach, the vent further comprising a plurality of air-conveying connectors each adapted to attach to the fitting in fluid communication with the opening, only one of the connectors being able to attach to the fitting at a time, the connectors having lower air-conveying portions of different sizes and/or shapes to be compatible with a plurality of different sizes and/or shapes of air conduits.

10. The vent of claim 1, further comprising a clip secured to the second member and adapted to secure the vent in position against winds, the clip being formed of metal or an alloy.

11. The vent of claim 10, wherein the clip slidably and releasably attaches to an adjacent tile on the roof.

12. The vent of claim 1, wherein the first member and second member are configured to releasably attach to each other to facilitate selective attachment and detachment of the first and second members while the second member remains installed on a roof.

13. The vent of claim 1, further comprising one or more spacers connecting the first and second members and providing the ventilation gap therebetween, wherein the one or more spacers are fixed to one of the first and second members and selectively attachable and detachable with respect to the other of the first and second members.

14. The vent of claim 1, wherein the opening is covered by a screen configured to substantially restrict the ingress of rain, vermin, and debris through the opening of the second member.

15. A vent for a tile roof, comprising:

a body formed substantially of a plastic material, the body having an opening; and a cover formed substantially of a metal or alloy, the cover substantially covering the body, the cover and the body having a gap therebetween such that a substantial entirety of a perimeter edge of the cover is spaced apart from the body by the gap, the perimeter edge including upslope, downslope, and lateral edges of the cover, the gap being in fluid communication with a region above the cover;

wherein the gap and the opening are together configured to permit airflow between the region above the cover and a region below the opening, the body and cover adapted to be positioned in a roof such that the cover is exposed at an upper surface of the roof.

16. A method of ventilating a building, the method comprising:

providing an air conduit having a lower end terminating within a building and an upper end terminating below and proximate to a roof having a layer of tiles;

providing a first vent member within the tile layer, the first member substantially formed of a metal or an alloy;

providing a second vent member substantially fixated of a plastic material, the second member being positioned below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member to substantially prevent rain from entering the opening, the ventilation gap being in fluid communication with an area above the first member;

attaching an air-conveying connector to an underside of the second member and in fluid communication with the opening; and connecting a lower air-conveying portion of the connector with the upper end of the air conduit to allow airflow from the air conduit upward through the connector, the opening, and the ventilation gap.

17. The method of claim 16, wherein providing the first member comprises providing a vent member that mimics an appearance of one or more of the tiles.

18. The method of claim 16, wherein a shape of the second member is substantially the same as a shape of the first member.

19. The method of claim 16, wherein providing the air conduit comprises providing a stack vent.

20. The method of claim 16, wherein connecting the lower-air-conveying portion of the connector with the upper end of the air conduit comprises:

providing a plurality of air-conveying adapters each having an upper end configured to connect with and convey air into the lower portion of the connector and a lower end configured to connect with and receive air from an upper end of a stack vent, only one of the adapters being able to connect with the lower portion of the connector at a time, the lower ends of the adapters having different sizes and/or shapes to be compatible with a plurality of different sizes and/or shapes of stack vents;

selecting one of the adapters, the selected adapter having a lower end configured to attach to and fluidly communicate with the upper end of the air conduit;

attaching the selected adapter to the lower portion of the connector in fluid communication with the opening; and attaching the lower end of the adapter to the upper end of the air conduit.

21. The method of claim 16, wherein the underside of the second member includes a fitting to which the connector is configured to attach, said attaching and connecting steps comprising:

providing a plurality of air-conveying connectors each adapted to attach to the fitting in fluid communication with the opening, only one of the connectors being able to attach to the fitting at a time, the connectors having lower air-conveying portions of different sizes and/or shapes to be compatible with a plurality of different sizes and/or shapes of air conduits;

selecting one of the connectors, the selected connector having a lower air-conveying portion configured to attach to and fluidly communicate with the upper end of the air conduit;

attaching the selected connector to the fitting in fluid communication with the opening; and attaching the lower portion of the selected connector to the upper end of the air conduit.

22. The method of claim 16, wherein providing the first member comprises releasably connecting the first member to the second member.

23. A vent for a roof, comprising:

a first member adapted to be positioned within and exposed at an upper surface of a roof;

a second member configured to attach to and be positioned below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member when the first and second members are attached to substantially prevent rain from entering the opening, the ventilation gap being in fluid communication with an area above the first member when the first and second members are installed within a roof; and an air-conveying connector configured to attach to an underside of the second member and in fluid communication with the opening, a lower air-conveying portion of the connector being configured to connect with an air conduit to allow airflow from the air conduit upward through the connector, the opening, and the ventilation gap;

wherein the first member and second member are releasably connected to each other to facilitate selective attachment and detachment of the first and second members while the second member remains installed on a roof.

24. The vent of claim 23, wherein the first member mimics an appearance of one or more roof tiles.

25. The vent of claim 23, wherein the second member is shaped substantially in conformity with the first member.

26. The vent of claim 23, further comprising one or more spacers connecting the first and second members and defining the ventilation gap, wherein the one or more spacers are fixed to one of the first and second members and selectively attachable and detachable with respect to the other of the first and second members.

27. The vent of claim 26, wherein the one or more spacers are configured to receive snap-lock members extending from one of the first and second members.

28. The vent of claim 23, further comprising a plurality of air-conveying adapters each having an upper end configured to connect with and convey air into the lower portion of the connector and a lower end configured to connect with and receive air from an upper end of a stack vent, the lower ends of the adapters having different sizes and/or shapes to be compatible with a plurality of sizes and/or shapes of stack vents.

29. The vent of claim 23, wherein the underside of the second member includes a fitting to which the connector is configured to attach, the vent further comprising a plurality of air-conveying connectors each adapted to attach to the fitting in fluid communication with the opening, the connectors having lower air-conveying portions of different sizes and/or shapes to be compatible with a plurality of different sizes and/or shapes of air conduits.

30. The vent of claim 23, wherein the first member is formed of metal or an alloy, the second member being formed of a plastic material.

31. A method of ventilating a building, comprising:

providing an air conduit having a lower end terminating within a building and an upper end terminating below and proximate to a roof having a tile layer;

providing a first vent member within the tile layer;

positioning a second vent member below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member to substantially prevent rain from entering the opening, the ventilation gap being in fluid communication with an area above the first member;

attaching an air-conveying connector to an underside of the second member and in fluid communication with the opening;

connecting a lower air-conveying portion of the connector with the upper end of the air conduit to allow airflow from the air conduit upward through the connector, the opening, and the ventilation gap; and releasably connecting the first and second members together to facilitate selective attachment and detachment of the first and second members while the second member remains installed on the roof.

32. The method of claim 31, wherein providing the first member comprises providing a vent member that mimics an appearance of one or more of the tiles.

33. The method of claim 31, wherein providing the second member comprises providing a vent member that is shaped in conformity with the first member.

34. The method of claim 31, further comprising providing one or more spacers connecting the first and second members and defining the ventilation gap, the one or more spacers being fixed to one of the first and second members and selectively attachable and detachable with respect to the other of the first and second members.

35. A vent for a roof, comprising:

a first member adapted to be positioned within and exposed at an upper surface of a roof;

a second member configured to attach to and be positioned below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member when the first and second members are attached to substantially prevent rain from entering the opening, the ventilation gap being in fluid communication with an area above the first member when the first and second members are installed within a roof; and a plurality of air-conveying connectors each configured to attach to a lower fitting of the second member and be in fluid communication with the opening, only one of the connectors being able to attach to the lower fitting at a time, a lower air-conveying portion of each connector being configured to connect with an air conduit to allow airflow from the air conduit upward through the connector, the opening, and the ventilation gap, the lower portions of the connectors having different sizes and/or shapes to be compatible with a plurality of different sizes and/or shapes of air conduits.

36. The vent of claim 35, wherein the first member mimics an appearance of one or more roof tiles.

37. The vent of claim 35, wherein a shape of the second member is substantially the same as a shape of the first member.

38. The vent of claim 35, wherein each of the connectors provides a substantially sealed connection between the second member and the air conduit.

39. A method of ventilating a building, the method comprising:

providing a stack vent having a lower end terminating within the building and an upper end terminating below and proximate to a roof having a layer of tiles;

providing a first vent member within the tile layer;

positioning a second vent member below and spaced apart from the first member to define a ventilation gap therebetween such that a substantial entirety of a perimeter edge of the first member is spaced apart from the second member by the ventilation gap, the perimeter edge including upslope, downslope, and lateral edges of the first member, the second member having at least one opening that is covered by the first member to substantially prevent rain from entering the opening, the ventilation gap being in fluid communication with an area above the first member;

providing a plurality of air-conveying connectors each configured to attach to a lower fitting of the second member and be in fluid communication with the opening, only one of the connectors being able to attach to the lower fitting at a time, a lower air-conveying portion of each connector being configured to connect with an air conduit to allow airflow from the air conduit upward through the connector, the opening, and the ventilation gap, the lower portions of the connectors having different sizes and/or shapes to be compatible with a plurality of sizes and/or shapes of air conduits;

selecting one of the connectors, the selected connector having a lower air-conveying portion configured to connect with and fluidly communicate with the upper end of the stack vent;

attaching the selected connector to the lower fitting of the second member in fluid communication with the opening; and connecting the lower portion of the selected connector to the upper end of the stack vent.

40. The method of claim 39, wherein the first member mimics an appearance of one or more of the tiles.

41. The method of claim 40, wherein a shape of the second member is substantially the same as a shape of the first member.

42. The vent of claim 35, wherein each of the connectors is configured to attach to the lower fitting of the second member via a tongue-and-groove connection.

43. The method of claim 39, wherein each of the connectors is configured to attach to the lower fitting of the second member via a tongue-and-groove connection.

* * * * *